US010070484B2

(12) United States Patent
Thompson et al.

(10) Patent No.: US 10,070,484 B2
(45) Date of Patent: Sep. 4, 2018

(54) APPARATUS, SYSTEM, AND METHOD FOR A HEATING SURFACE HAVING A SELECTABLE SHAPE, SIZE, LOCATION, AND HEAT INTENSITY

(71) Applicant: Colorado State University Research Foundation, Fort Collins, CO (US)

(72) Inventors: Kevin N. Thompson, Fort Collins, CO (US); Sam M. Foster, Fort Collins, CO (US); Craig M. Cogdill, Fort Collins, CO (US); Stanley Nestler, Fort Collins, CO (US)

(73) Assignee: Colorado State University Research Foundation, Fort Collins, CO (US)

( * ) Notice: Subject to any disclaimer, the term of this patent is extended or adjusted under 35 U.S.C. 154(b) by 395 days.

(21) Appl. No.: 14/245,879

(22) Filed: Apr. 4, 2014

(65) Prior Publication Data

US 2014/0305928 A1 Oct. 16, 2014

Related U.S. Application Data

(60) Provisional application No. 61/810,971, filed on Apr. 11, 2013.

(51) Int. Cl.
*H05B 3/74* (2006.01)
*H05B 1/02* (2006.01)

(52) U.S. Cl.
CPC ..... *H05B 1/0266* (2013.01); *H05B 3/74* (2013.01); *H05B 3/746* (2013.01); *H05B 2203/014* (2013.01); *H05B 2213/03* (2013.01); *H05B 2213/05* (2013.01)

(58) Field of Classification Search
CPC ..... H05B 3/746; H05B 6/062; H05B 6/065; H05B 6/1218; H05B 3/74; H05B 1/0266; H05B 2203/014; H05B 2213/03; H05B 2213/05
See application file for complete search history.

(56) References Cited

U.S. PATENT DOCUMENTS

| | | | | |
|---|---|---|---|---|
| 6,693,262 | B2 * | 2/2004 | Gerola | H05B 3/74 219/462.1 |
| 7,173,221 | B2 | 2/2007 | Lerner | |
| 7,425,690 | B2 * | 9/2008 | Schilling | H05B 3/746 219/451.1 |
| 7,759,616 | B2 | 7/2010 | Gouardo et al. | |

(Continued)

FOREIGN PATENT DOCUMENTS

GB 2061679 A 5/1981

OTHER PUBLICATIONS

International Search Report and Written Opinion, PCT/US2014/033196, dated Nov. 7, 2014.

*Primary Examiner* — Brian Jennison
(74) *Attorney, Agent, or Firm* — Polsinelli PC

(57) ABSTRACT

A heating appliance includes a heating structure having a lower surface and a flat upper surface for supporting and imparting heat into an object, such a pot or pan used to cook food. The heating structure includes an array of heating elements arranged on the lower surface of the heating structure in an m×n array having m columns and n rows. Each element is thermally coupled to a region of the structure for heating its respective region of the structure independently of other regions of the structure associated with the other heating elements.

20 Claims, 10 Drawing Sheets

(56) References Cited

U.S. PATENT DOCUMENTS

| | | | | |
|---|---|---|---|---|
| 7,919,730 | B2 | 4/2011 | Shaw et al. | |
| 2011/0168694 | A1* | 7/2011 | Sadakata | H05B 6/062 219/624 |
| 2011/0253693 | A1* | 10/2011 | Lyons | A47J 27/00 219/209 |
| 2011/0272397 | A1* | 11/2011 | Artal Lahoz | H05B 6/065 219/622 |
| 2012/0074127 | A1* | 3/2012 | Abbott | H05B 6/1272 219/486 |
| 2013/0271809 | A1* | 10/2013 | Gerszberg | H05B 33/0857 359/238 |

* cited by examiner

APPARATUS, SYSTEM, AND METHOD FOR A HEATING SURFACE HAVING A SELECTABLE SHAPE, SIZE, LOCATION, AND HEAT INTENSITY

RELATED APPLICATIONS

This application takes priority to U.S. Provisional Patent Application Ser. No. 61/810,971, filed Apr. 11, 2013, and entitled "HexHeat An Independently Matrix-able Array of Heating Elements," the contents of which is incorporated herein by reference in its entirety.

FEDERALLY SPONSORED RESEARCH OR DEVELOPMENT

Not Applicable.

COMPACT DISK APPENDIX

Not Applicable.

FIELD OF INVENTION

The present invention generally relates to heating devices, and more particularly, to an apparatus, system, and method for a heating surface having a selectable shape, size, location, and heat intensity.

BACKGROUND

Stovetops, also referred to cooktops, stoves, cookstoves, hotplates, cookers, and the like, generally refer to devices for cooking food. Nevertheless, it should be appreciated that these devices have also been used for other purposes, such as heating a room, preparation of chemical formulations needing heat to promote chemical reactions, and the like. The stovetop generally includes an upper surface for supporting and heating the food using a pot or pan that contains the food while being in direct contact with the stovetop for transferring the heat generated by the stovetop to the food in the pot or pan.

Nevertheless, stovetops often have certain drawbacks that limit their usefulness. For example, conventional stovetops typically have a heating surface whose size, shape, and location on the stovetop that are fixed and cannot be changed. Due to this fixed-size limitation, a pot or pan having a contact surface larger than the size of the stovetop using conductive or convective heating may exhibit uneven heating across its surface, while a pot or pan smaller than the size of the stovetop may leave portions of the stovetop exposed thus reducing the efficiency of the stovetop and even possibly forming a safety hazard for users who may inadvertently come in contact with the exposed heating surface. It is with these drawbacks in mind that embodiments of the present invention have been developed.

SUMMARY

According to one aspect of the present disclosure, a heating appliance includes a heating structure having a lower surface and a flat upper surface for supporting and imparting heat into an object, such as a pot or pan used to cook food. The heating structure includes an array of heating elements arranged on the lower surface of the heating structure in an m×n array having m columns and n rows. Each element is thermally coupled to a region of the structure for heating its respective region of the structure independently of other regions of the structure associated with the other heating elements.

According to another aspect of the present disclosure, a selective shape and size heating system includes multiple heating elements that are controlled by a controller. The heating elements are arranged on a heating structure in which each element is thermally coupled to a region of the structure for heating its respective region of the structure independently of other regions of the structure associated with the other heating elements. The controller receives information associated with a selected shape and size of a portion of the heating structure to be heated, determines a subset of the heating elements to be used for heating the selected shape and size of the heating structure, and controls the subset of heating elements to heat their respective regions of the heating structure.

According to yet another aspect of the present disclosure, a heating method includes receiving, using a computing system, information associated with a shape and size of a portion of the heating structure to be heated. The heating structure including multiple heating elements arranged on a heating structure in which each element is thermally coupled to a region of the structure for heating its respective region of the structure independently of other regions of the structure associated with the other heating elements. The method also includes determining, using the processor, a subset of the heating elements to be used for heating a selected received shape and size of the heating structure, and controlling, using the processor, the subset of heating elements to heat their respective regions of the heating structure.

DETAILED DESCRIPTION

Figure 1A:
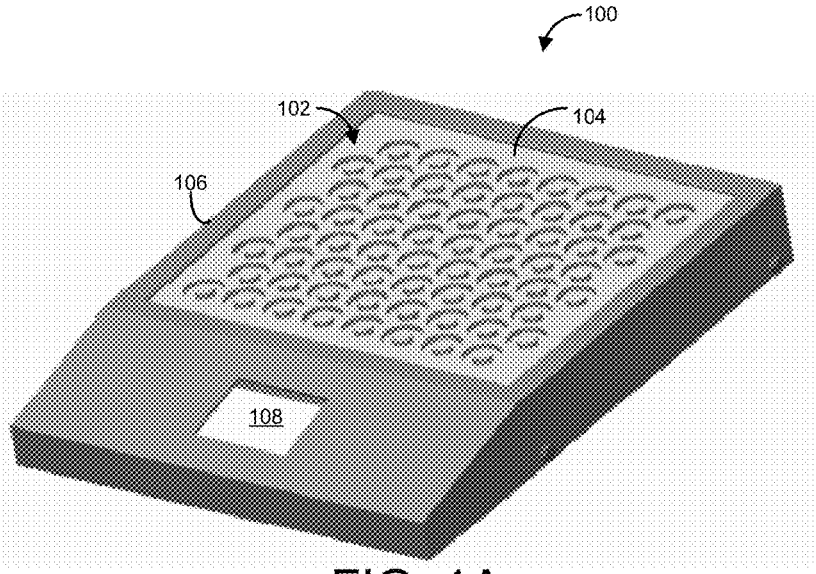
FIGS. 1A through 1C illustrate a perspective view, top view, and bottom view, respectively, of an example stovetop according to the teachings of the present disclosure.
Figure 1B:
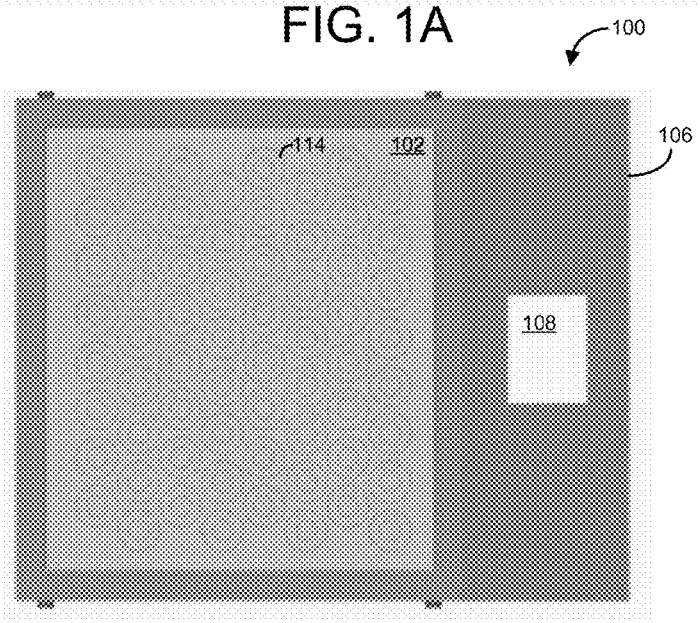
Figure 1C:
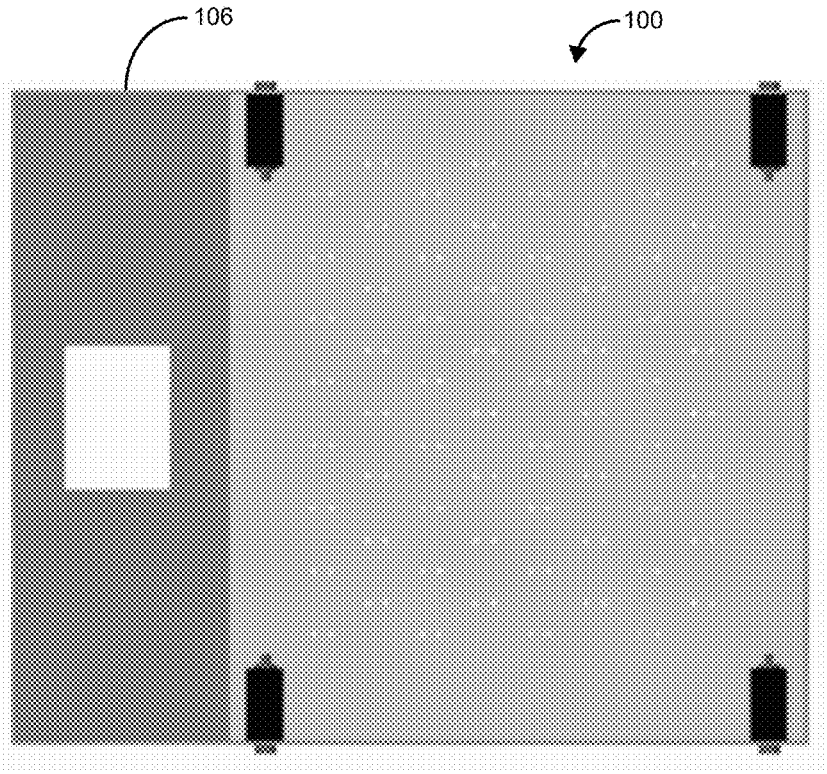

Although stovetops have, in general, provided a useful service of heating and/or otherwise cooking food, they often fall short in several different ways. For example, currently available stovetops are typically limited to heating surfaces having a predetermined size, shape, and location. Oftentimes there are simply not enough burners for the amount of food that needs to be cooked, or number of people that need to cook. Additionally, instances exist when a larger burner is needed, in which case the user may have to turn on two burners, or wait longer for the cookware to heat, with the adverse effect of uneven heat distribution. Conversely, instances exist when a user needs a smaller burner and must be content wasting the extra heat, thus reducing the efficiency of the stovetop. Also, instances exist when a user needs to use a burner having a square or rectangular shape, but is limited to a circular shape, which may also cause uneven heat distribution.

Embodiments of the present disclosure provide a solution to this problem using a stovetop configured with an array of individual heating elements that may be selectively energized to provide a desired shape, size, location, and heat intensity of heating surface that conforms to the shape, size, and location of a pot or pan or other object to be heated that is placed upon its surface. Using this design, heat generated by the stovetop may be optimally transferred to the pot or pan for enhancing its efficiency over traditional stovetops whose shape, size, and location of heating surface cannot be tailored according to the user's needs. Additionally, embodiments of the present disclosure provide several features for enhancing the safety and security of the stovetop, such as a security mechanism that restricts use of the stovetop to proper entry of a passcode or other authorization information, such as a finger scan.

FIGS. 1A through 1E illustrate an example stovetop 100 according to the teachings of the present disclosure. The stovetop 100 includes a heating structure 102 with a flat upper surface 104 on which objects, such as pot or pans may be supported for heating food stored therein. The heating structure 102 also includes a housing 106 for housing the various components of the stovetop and includes an opening into which a display 108 of a stovetop controller may be mounted for entry of user input for controlling operation of the stovetop 100.

The heating structure 102 includes an element mounting member 110 with an array of donut-shaped dimples 114 on its surface for a corresponding number of heating elements 116 disposed within the element mounting member 110. The donut-shaped dimples 114 each house a semi-circular shaped heating element 166 therein. Although each region of the element mounting member 110 is shown herein as being surrounded by a donut-shaped depression, it should be understood that that regions of the element mounting member 110 may have any suitable shape that provides thermal coupling of the heating elements 116 to the upper surface while providing thermal isolation from other nearby heating elements 116.

Figure 1D:
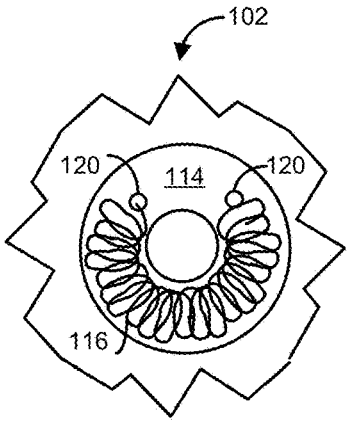
FIG. 1D illustrates an enlarged, partial, top view of the heating structure according to the teachings of the present disclosure.
Figure 1E:
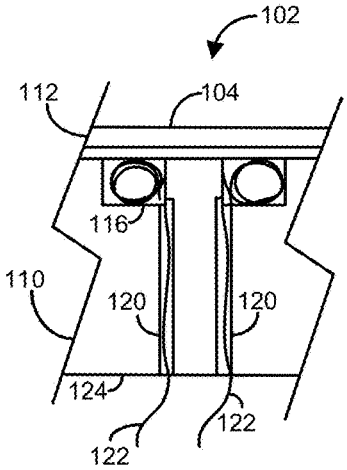
FIG. 1E illustrates an enlarged, partial, cut away side view of the heating structure according to the teachings of the present disclosure.

As best shown in FIGS. 1D and 1E, each donut-shaped dimple 114 of the element mounting member 110 houses a heating element 116, which in this particular embodiment, is an elongated section of electrically resistive material bent into a coil. Two holes 120 extend from the dimple 114 to a bottom surface 124 of the element mounting member 110 for routing wires 122 to the heating element 116. The electrically resistive material may be any type of material that is heated when energized by an electrical source of power. For example, the electrically resistive material may include nichrome wire, molybdenum disilicide, barium titanate, and/or lead titanate ceramic material.

The element mounting member 110 is made of a material having a relatively good tolerance to heat, such as ceramics, or fire brick. A glass plate 112 is provided adjacent to the element mounting member 110 for thermal coupling of the glass plate 112 to the element mounting member. The glass plate 112 provides protection for the element mounting member 110 and forms the upper surface of the heating structure 102 for support of pots, pans, or other objects to be heated.

Although the heating element 116 as described herein includes an electrically resistive material for generating heat under the influence of electrical power, other embodiments may include other forms of heating mechanisms, such as peltier devices, or induction devices that induce heat into objects on the heating surface using magnetic fields.

FIGS. 2A through 2D illustrate another embodiment of an element mounting member 200 and associated heating elements 216 according to the teachings of the present disclosure. The element mounting member 200 may be housed in the housing 106, placed adjacent the glass plate 112, and controlled by a controller similarly to the element mounting member 110 as shown and described above with respect to FIGS. 1A through 1C. The element mounting member 200 differs, however, from the element mounting member 110 in that the element mounting member 200 is configured to accept heating elements 216 made of an electrical resistive material formed into a semi-circular shape and disposed proximate the upper surface of the element mounting member 200.

An additional difference between the element mounting member 200 and the element mounting member 110 is that the element mounting member 200 is configured to accept and support light indicators 202 for each heating element 216 in which each light indicator 202 is energized to emit light when its respective heating element 216 is energized thus providing a visual indication of which heating elements 216 are being energized at any given point in time.

Each light indicator 202 is formed from an elongated section of fiber-optic cable 204 encased in a protective shell made of fiberglass or other material having relatively good heat resistant characteristics. Additionally, the light indicator 202 includes a light source 206, such as a light emitting diode (LED) that is optically coupled to its respective light fiber-optic cable 204 such that light generated by the light source 202 is conveyed, via the fiber-optic cable, to the upper surface 104 of the glass plate 112 that overlays the element mounting member 200. Although the light indicator 202 is described herein as a light source 206 optically coupled to a fiber-optic cable 204, it is contemplated that any suitable type of light source may be used that is sufficiently heat tolerant to remain functional when subjected to heat typically encountered when the heating elements 216 are energized.

In the particular example embodiment shown, the element mounting member 200 includes an array of depressions 212 that are arranged in a hexagonal-shaped array across the element mounting member 200 in which each heating element 216 is mounted within one depression 212. In a particular embodiment, each depression 212 is approximately 1.10 inches across its periphery and are spaced apart at approximately 1.25 inches between the central axis of each element. Nevertheless, it should be appreciated that the element mounting member 200 may have depressions of any suitable size, such as greater than 1.10 inches across its periphery or less than 1.10 inches across its periphery. Additionally, the depressions 212 may be spaced apart at a distance that is less than 1.25 inches or greater than 1.25 inches.

Figure 2A:
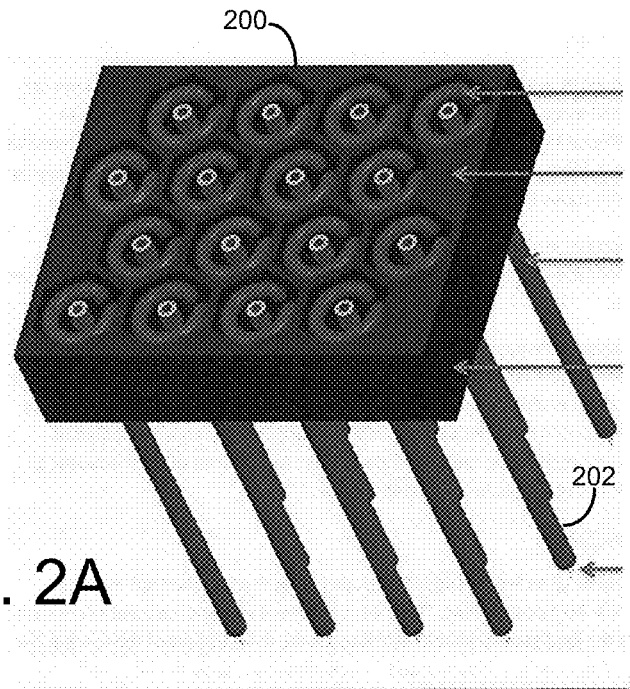
FIGS. 2A through 2C illustrate a perspective view, top view, and bottom view, respectively, of another example heating structure according to the teachings of the present disclosure.
Figure 2B:
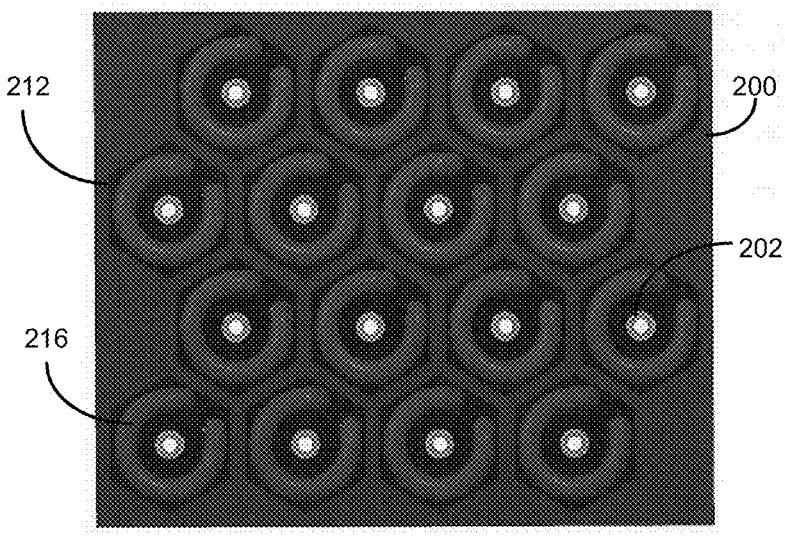
Figure 2C:
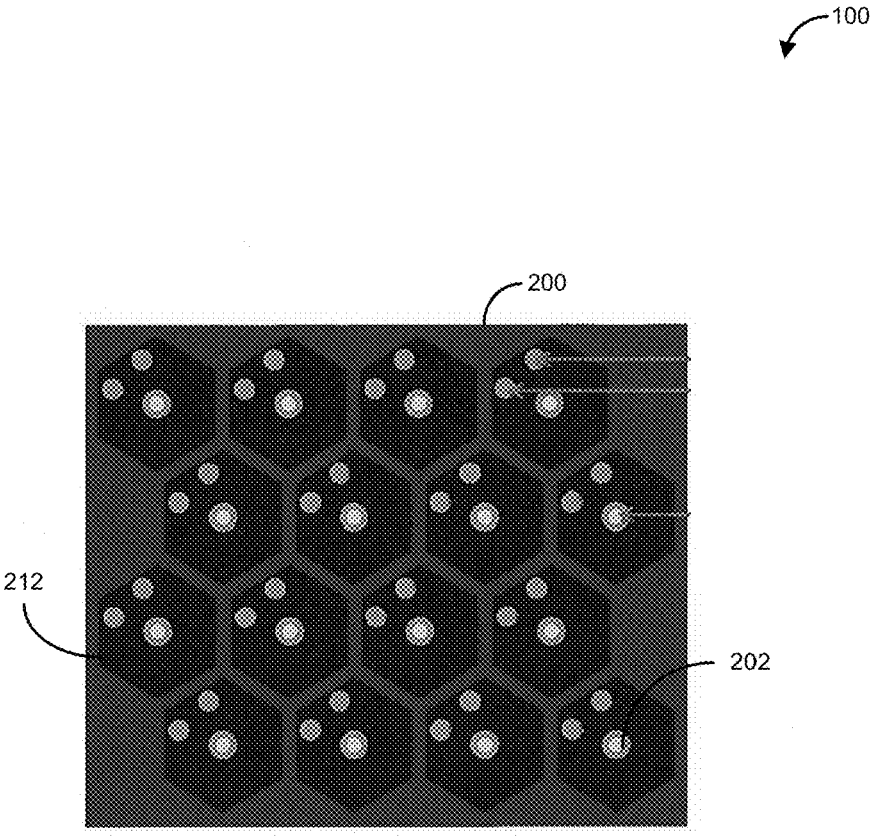
Figure 2D:
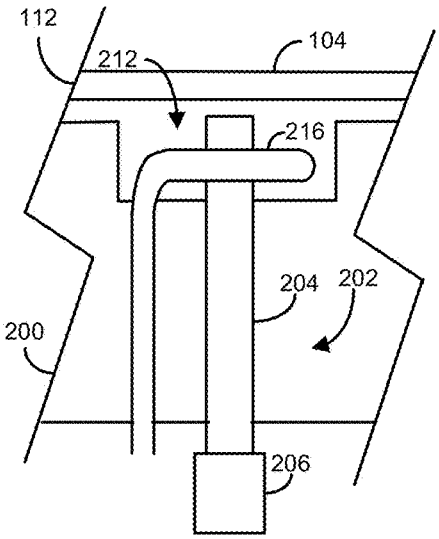
FIG. 2D illustrates an enlarged, partial, cut away view of the heating structure according to the teachings of the present disclosure.

The heating elements 216 may be any type that generates heat when electrically energized. Each heating element 216 includes an elongated section of heat generating material, such as calrod material, that is bent into a semi-circular shape. The selected material from which the heating elements 216 are made have a specified resistivity to generate sufficient heat when fashioned into the length as shown in FIG. 2A when bent to form their semi-circular shape.

Figure 3A:
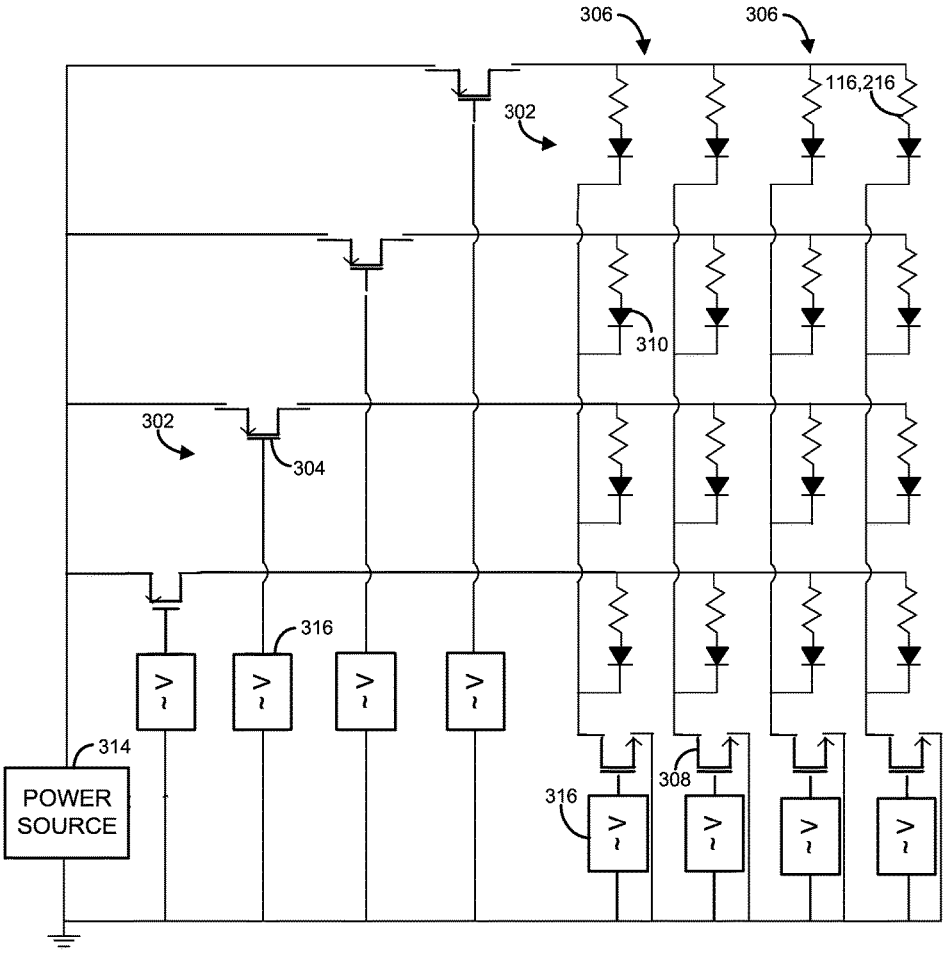
FIGS. 3A and 3B illustrate example heating element driver circuits according to the teachings of the present disclosure.
Figure 3B:
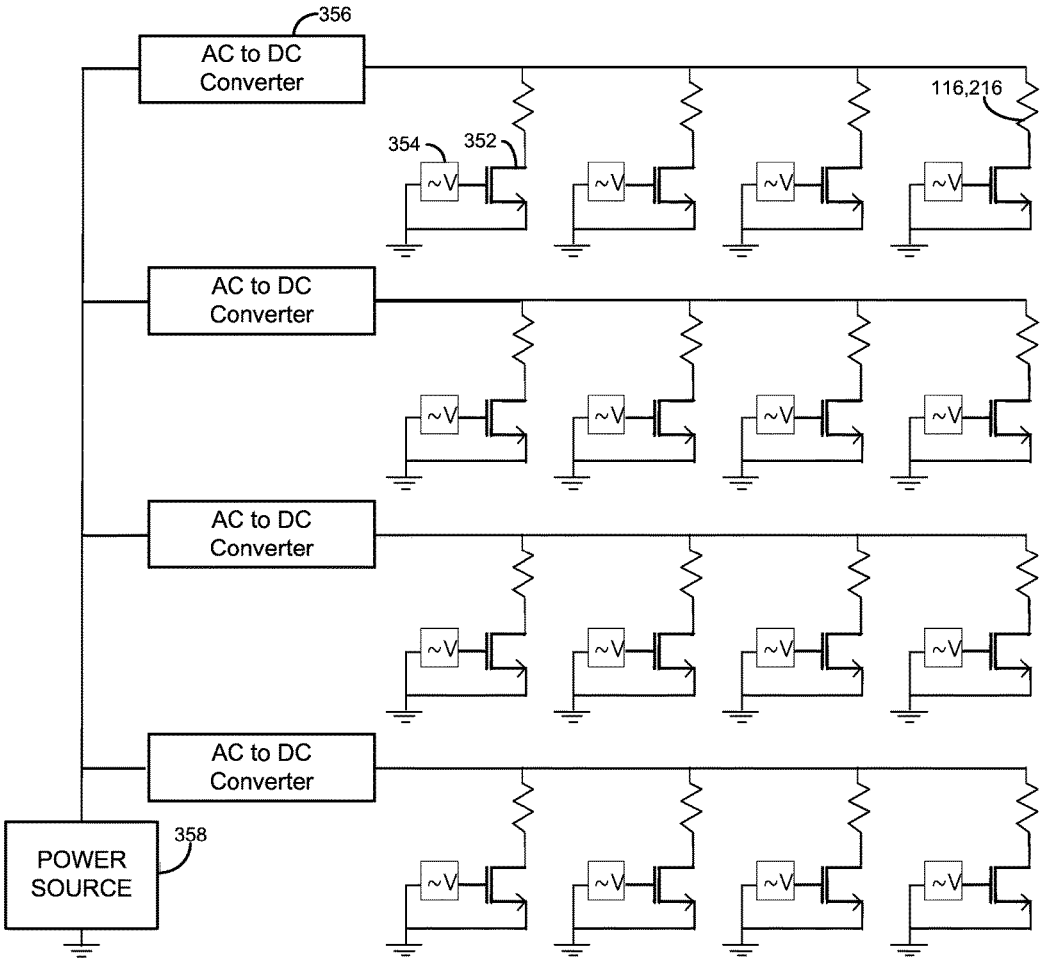

FIGS. 3A and 3B illustrate example heating element driver circuits 300 and 350, respectively, that may be used to energize heating elements of the heating structures of FIGS. 1A through 1E and FIGS. 2A through 2D according to embodiments of the present disclosure. As shown, the heating element driver circuit 300 of FIG. 3A is configured to selectively energize heating elements arranged in a 6×6 array, while the heating element driver circuit 350 of FIG. 3B is configured to selectively energize heating elements arranged in a 4×4 array. Nevertheless, it should be understood that the heating element driver circuits 300 may be used to energize heating elements arranged in any suitably sized array, such as an 8×8 array of heating elements as shown in the heating structure of FIGS. 1A through 1E.

Heating element driver circuit 300 generally refers to a scanning circuit in which heating elements 116,216 are alternatively energized from a common power source 314, which may be an alternating current (AC) source or a direct current (DC) source. In this circuit arrangement, individual rows 302 of heating elements 116,216 are selectively energized by row switches 304, while columns 306 of the heating elements 116,216 are selectively energized by column switches 308. Additionally, each heating element 116, 216 is coupled in series connection to a diode 310 to ensure that electrical current is restricted to flow in one direction, for example, in response to inductive loading of the heating elements 116,216 that may cause transient voltage spikes when the switches turn off. In the particular example shown, the diodes are schottky diodes that exhibit a relatively low voltage drop in the forward bias condition, although any type of diode may be used. In other embodiments, the diodes may be omitted if restriction of reverse current flow through the heating elements is not needed or desired.

Although the row switches 304 and column switches 308 shown in this particular example are metal oxide semiconductor field effect transistors (MOSFETs), it should be understood that any suitable solid-state device, or mechanical switch may be used, such as relays, insulated gate bipolar transistors, or other bipolar transistors. For the row switches 304 and column switches 308 embodied as MOSFETs, when control signals 316 have voltage greater than the threshold voltage $V_{threshold}$ of the MOSFETs, the MOSFETs turn on, and are represented as a logic 'hi' condition. Conversely, when signals 316 have voltage at least less than the threshold voltage $V_{threshold}$ of the MOSFETs, the MOSFETs turn off, and are represented as a logic 'lo' condition. The control signals 316 are generated by a controller that will be described in detail herein below.

The heating element driver circuit 300 functions in a scanning mode for selectively energizing each heating element 116,216. The heating elements are arranged in an m×n array having m columns and n rows in which each m'th column of heating elements electrically coupled to one column switch for selectively energizing its respective m'th column of heating elements, and each n'th row of heating elements is electrically coupled to one row switch for selectively energizing its respective n'th row of heating elements. That is, the row switches 304 and column switches 308 are alternatively turned on to apply electrical power from a power source 314 to selected ones of the heating elements 116,216. For example, a particular row switch 304 may be turned on while certain column switches 308 are turned on to energize those heating elements 116,216 coupled to that row switch 304 and column switches 308. In this manner, the controller, via the generated control signals 316, may selectively turn on certain heating elements 116, 216 for heating a desired portion of the heating surface of the heating structure.

As shown in FIG. 3B, the heating element driver circuit 350 includes multiple switches 352 that are controlled by control signals 354, which are similar in design and construction to the switches and control signals of the heating element driver circuit 300 of FIG. 3A. The heating element driver circuit 350 of FIG. 3B, however, differs from the heating element driver circuit 300 of FIG. 3A in that a switch 352 is provided for each heating element 116,216 in the heating structure. Thus, the heating element driver circuit 350 functions in a static mode in which selected heating elements 116,216 to be heated are statically turned on via control signals 354 generated by the controller. Thus, the heating elements 116,216 may be operated at or about 100 percent duty cycle, while the heating elements 116,216 of the heating element driver circuit 300 of FIG. 3A may be required to operate at a duty cycle that is less than 100 percent.

The heating element driver circuit 350 also includes multiple power conversion circuits 356 that converts a power source 358 to corresponding rows of heating elements 116,216. The power conversion circuits 356 may be any type that converts an available source of electrical power to a form suitable for use by the heating elements and switches. In the particular example shown, the power conversion circuits 356 are alternating current (AC) to direct current (DC) power conversion circuits that convert the alternating current power source to DC power. Nevertheless, the power conversion circuits 356 may be omitted if conversion of the power source 358 to a different form is not needed or desired.

Although FIGS. 3A and 3B illustrate examples of heating element driver circuits that may be used for energizing the heating elements under control of a controller, other embodiments of heating element driver circuits may be implemented without departing from the spirit and scope of the present disclosure. For example, buffer circuits may be included between control signals 316 and 354 and their respective switches that amplifies the drive current provided by the control signals for enhanced switching of the switches.

Figure 4A:
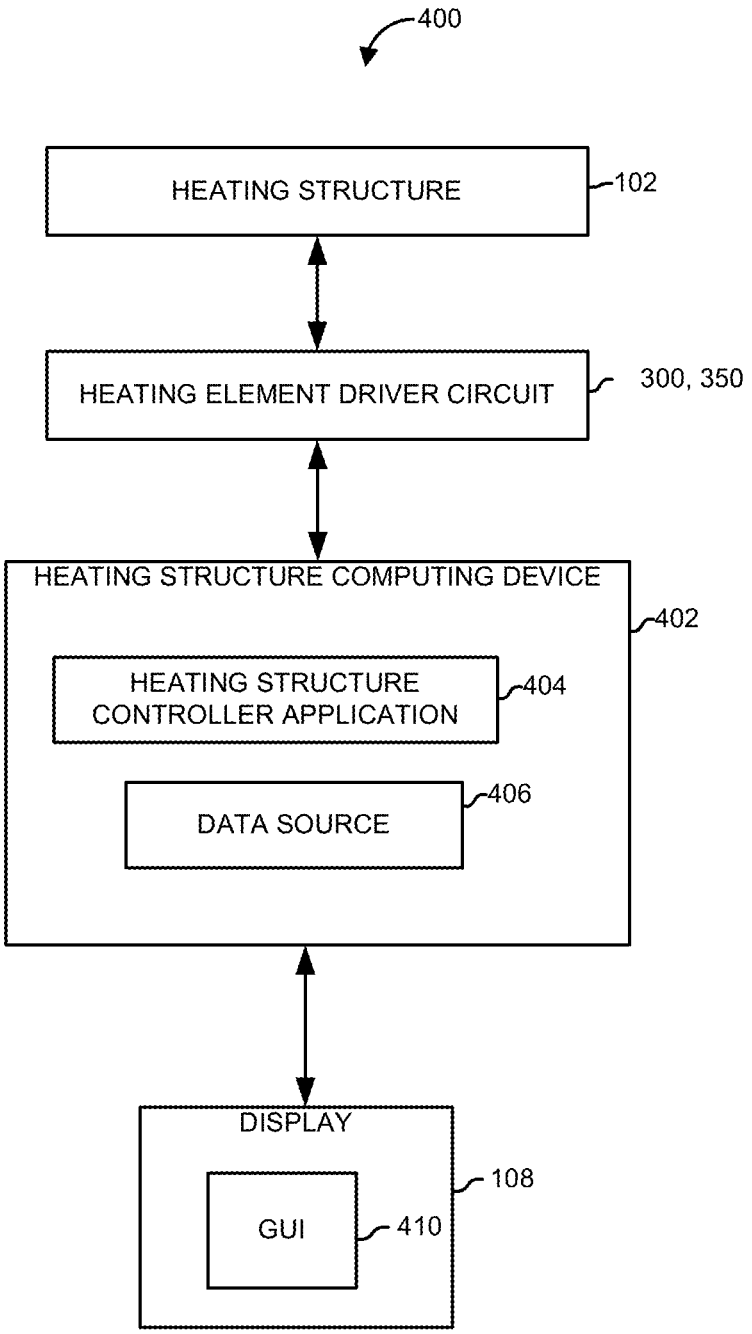
FIG. 4A illustrates an example selective heating surface control system according to the teachings of the present disclosure.
Figure 4B:
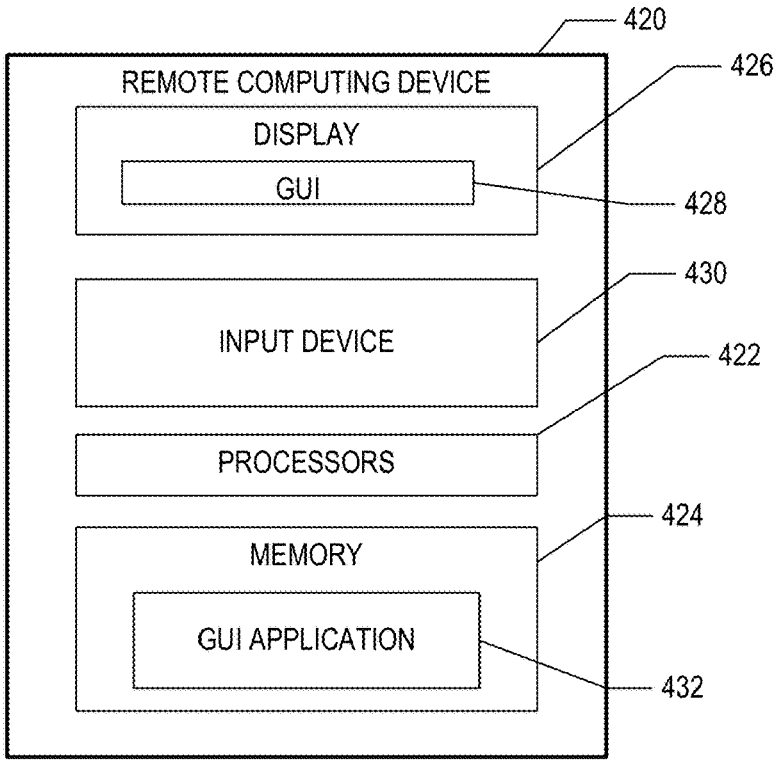
FIG. 4B illustrates an example remote computing system according to the teachings of the present disclosure.
Figure 4C:
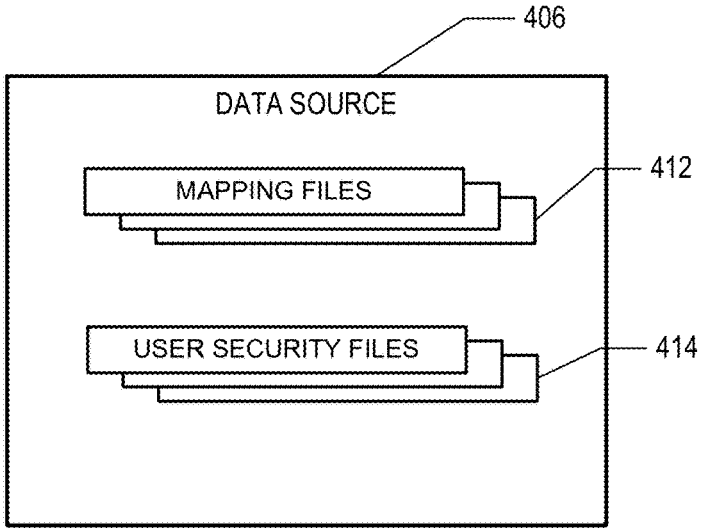
FIG. 4C illustrates an example data source according to the teachings of the present disclosure.

FIGS. 4A through 4C depict an example stovetop control system 400 according to aspects of the disclosure that may be used to control the operation of the heating structure 102 as described above. Nevertheless, it should be understood that the stovetop control system 400 may be configured to control the operation of any type of stovetop having multiple heating elements that may be individually energized to selectively heat differing regions of the stovetop.

The stovetop control system 400 includes a heating structure computing device 402 that controls the heating structure using a heating structure controller application 404 and a data source 406. As will be described in detail below, the heating structure controller application 404 receives shape, size, location, and heat intensity information associated with a desired region of the heating structure to be heated and controls the heating structure 102, via a heating structure driver circuit 300, 350, to energize a subset of the heating elements in the heating structure 102 such that a region of the heating structure 102 having the desired shape, size, location, and heat intensity is heated.

A display 108 is also provided that provides for user entry of various operating aspects of the heating structure 102. For example, the application 404 may generate a graphical user interface (GUI) 410 on the display 108 that receives user input associated with various operating aspects of the heating structure 102, such as a temperature setting of the heating structure 102, a timer setting indicating how long the selected temperature setting is to be maintained, and other operating characteristics associated with the operation of the heating structure 102.

In one embodiment, the application 404 receives the shape, size, location, and/or heat intensity information that has been manually inputted by the user. For example, the display 108 may be a touchscreen in which the application 404 generates a request on the GUI 410 of the display 108 for the user to select a desired shape and size of the heating structure 102 to be heated, and receives user input in the form of finger gestures indicating the desired the shape, size, location, and/or heat intensity of the heating structure 102 to be heated.

In another embodiment, the application 404 automatically receives shape, size, location, and/or heat intensity information using multiple sensors mounted inside the heating structure 102 that are used to automatically indicate the shape, size, location, and/or heat intensity of the object supported on the heating structure 102. For example, those heating elements that are disposed directly beneath a pot or pan may have greater heat sinking capability than other heating elements not having the pot or pan supported thereon. Thus, sensors embodied as thermal sensors may be configured proximate each heating element. The application 404 may individually receive signals from each thermal sensor to detect this difference in thermal sinking capability and automatically remove or turn off those heating elements with the reduced heat sinking capability. In some embodiments, the automatic shape, size, location, and/or heat intensity determination may be conducted during a relatively short sensing process during the operation of the heating structure 102. Additionally, the automatic shape, size, location, and/or heat intensity sensing process may be conducted at periodic intervals (e.g., every 10 minutes) to automatically adjust for occasional movement of the pot or pan on the heating structure 102 while being heated. As another example, the sensors may be embodied as light sensors in which the shape, size, location, and/or heat intensity of the pot or pan is detected due to light that is blocked proximate each heating element.

The application 404 may also include one or more security features to reduce potential hazards associated with operation of the heating structure 102. For example, the application 404 may restrict operation of the heating structure 102 to proper entry of a password or passcode via the GUI 410 by the user. Additionally, the application 404 may restrict operation of the heating structure 102 via a fingerprint scanner that receives a fingerprint image from a potential user and compares with one or more stored images to ensure that only authorized users are allowed to operate the system 400.

The heating structure computing device 402 includes a processing system 502 (FIG. 5) that executes the heating structure controller application 404 stored in volatile and/or non-volatile memory 504 (i.e., computer readable media) (FIG. 5) using the data source 406. Examples of a suitable heating structure computing device 402 include one or more servers, personal computers, mobile computers and/or other mobile devices, and other computing devices. In one embodiment, the heating structure computing device 402 is a commercial off-the-shelf (COTS) computing device, such as a personal computer, a mobile computer, a tablet computer, a mobile device, and/or other computing device that is configured in or on the housing 106 using one or more mounting mechanisms, such as screws, bolts, hooks, zip ties, adhesives, track system, or other attachment mechanisms. Additionally, the heating structure computing device 402 may be configured on the housing 102 such that its display is oriented in either a landscape mode or a portrait mode.

The data source 406 stores standard shape mapping files 412 and one or more user security files 414. The standard shape mapping files 412 include information associated with one or more standard two-dimensional shapes that may be used by the application 404 for selectively energizing certain heating elements of the heating structure. The user security files 414 includes information associated with user authorization, such as passwords, passcodes, fingerprint scan information, and the like, that may be used by the application 404 to restrict operation of the heating structure according to proper authorization by its user.

Although the display 108 is shown directly coupled to the heating structure computing device 402, other embodiments contemplate that the display 108 is configured on another computing device 420 that is separate and distinct from the heating structure computing device 402 used to control the operation of the heating structure 102. For example, the display 108 may be embodied on a remote computing device 420, such as a smartphone, that executes a mobile app to communicate with the heating structure computing device 402 using a communication network for conveying control information, such as temperature settings, timer settings, and/or shape, size, location, and/or heat intensity information to the heating structure computing device 402 for controlling the heating structure 102. The communication network can be the Internet, an intranet, or another wired and/or wireless communication network. In one aspect, the display embodied on the remote computing device 420 may communicate with the heating structure computing device 402 using any suitable protocol or messaging scheme. For example, the remote computing device 420 and heating structure computing device 402 may communicate using a Hypertext Transfer Protocol (HTTP), extensible markup language (XML), extensible hypertext markup language (XHTML), or a Wireless Application Protocol (WAP) protocol. Other examples of communication protocols exist.

FIG. 4B depicts an example embodiment of a remote computing device 420 that may be used to communicate with the heating structure computing device 402 according to one aspect of the heating structure control system 400. The remote computing device 420 is a computing or processing device that includes one or more processors 422 and memory 424 and is to receive data and/or communications from, and/or transmit data and/or communications to, the heating structure computing device 402. The remote computing device 420 includes a display 426, which may be, for example, a computer monitor, for displaying data and/or a graphical user interface (GUI) 428. The remote computing device 420 may also include an input device 430, such as a keyboard or a pointing device (e.g., a mouse, trackball, pen, or touch screen) to enter data into or interact with the graphical user interface 428. In one embodiment, the display 426 comprises a touchscreen device in which input is provided via contact by the user with the touchscreen device.

The remote computing device 420 may also include a graphical user interface (or GUI) application 432, such as a browser application, or application software (i.e., a mobile app) stored in the memory 424 and executed on the processors 422 to generate a graphical user interface 428 to the display 108. The graphical user interface 428 enables the remote computing device 420 of the user to interact with one or more data entry forms received from the heating structure computing device 402 to enter detail data and transmit the entered detail data for controlling operation of the heating structure.

Figure 5:
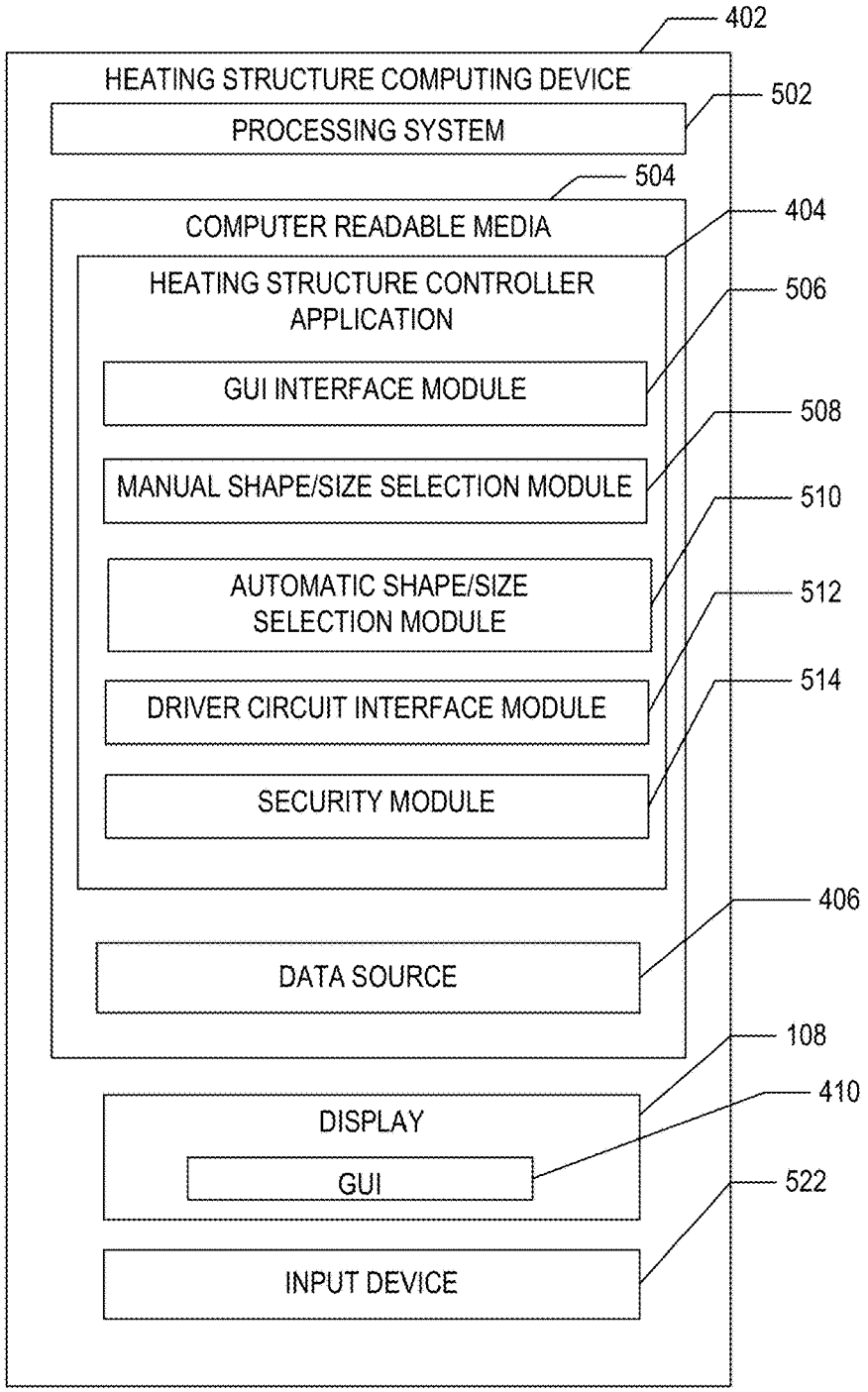
FIG. 5 illustrates an example computing device that includes a heating structure controller application according to the teachings of the present disclosure.

FIG. 5 is a block diagram depicting an example heating structure controller application 404 executing on the heating structure computing device 402. According to one aspect, the heating structure computing device 402 includes a processing system 502 that includes one or more processors or other processing devices. A processor is hardware. The processing system 502 executes the heating structure controller application 404 to generate a GUI on the display 108 in order to receive operating information from a user and control operation of the heating structure according to the received information. The heating structure computing device 402 may also include an input device 522, such as a keyboard or a pointing device (e.g., a mouse, trackball, pen, or touch screen) to enter data into or interact with the graphical user interface 410.

According to one aspect, the heating structure computing device 402 includes a computer readable media 504 on which the heating structure controller application 404 and data source 406 are stored. The heating structure controller application 404 includes instructions or modules that are executable by the processing system 502 to manage operation of the heating structure.

The computer readable media 504 may include volatile media, nonvolatile media, removable media, non-removable media, and/or another available media that can be accessed by the stored value card activation heating structure computing device 402. By way of example and not limitation, computer readable media 504 comprises computer storage media and communication media. Computer storage media includes non-transient storage memory/media, volatile media, nonvolatile media, removable media, and/or non-removable media implemented in a method or technology for storage of information, such as computer/machine readable/executable instructions, data structures, program modules, and/or other data. Communication media may embody computer readable instructions, data structures, program modules, or other data and include an information delivery media or system.

A GUI interface module 506 facilitates the receipt of data and/or other information from the display 108 for configuring operation of the heating structure. In one example, the GUI interface module 506 generates the graphical user interface (GUI) on the display 108 for displaying and receiving information from the user. As another example, the GUI interface module 506 may communicate with the GUI application 432 executed on a remote computing device 420 for displaying and receiving control information from a user of the remote computing device 420.

A manual shape/size/location/heat intensity selection module 508 receives information associated with a manual shape, size, location, and heat intensity of a portion of the heating structure to be heated and maps the selected shape, size, and location to certain heating elements 116 that will be energized in a manner to create a heated region on the heating structure having the selected shape, size, and location and a heat intensity to be applied to the selected heating elements. For example, the manual shape/size/location/heat intensity selection module 508 may display a number of standard shapes (e.g., circles, rectangles, squares, triangles, hexagons, and the like) stored in the standard shape mapping files 412 for view on the GUI 410 and receive selection of one shape from the GUI 410 entered by the user. Additionally, the manual shape/size/location/heat intensity selection module 508 may display a request for a size to be heated, which may include, for example, a request for an approximate diameter and location of the shape to be heated and receive the selected size and location information according to the generated request. As another example, the manual shape/size/location/heat intensity selection module 508 may display a request for a heat intensity to be applied to the heating elements, and receive the selected heat intensity information according to the generated request.

An automatic shape/size/location/heat intensity selection module 510 generates shape, size, location, and heat intensity information associated with a shape, size, location, and heat intensity of the portion of the heating structure to be heated according to sensor information received from one or more sensors configured in the heating structure. For example, the automatic shape/size/location/heat intensity selection module 510 may receive shape/size/location/heat intensity information from multiple light sensors configured proximate each heating element that detects the presence of a pot or pan at each heating element for automatically determining the shape, size, location, and/or heat intensity of the heating structure to be heated.

A driver circuit interface module 512 receives shape, size, location, and heat intensity information from the manual shape/size/location/heat intensity selection module 512 or the automatic shape/size/location/heat intensity selection module 512 and maps the received information into control signals that are transmitted to the heating element driver circuit 300, 350 for selectively energizing each heating element of the heating structure according to the shape/size/location/heat intensity information. For example, the driver circuit interface module 512 may receive shape, size, location, and heat intensity information representing a circle having a diameter of 6.0 inches from either the manual shape/size/location/heat intensity selection module 508 or the automatic shape/size/location/heat intensity selection module 510. Given this information, the driver circuit interface module 512 maps this information into a selected subset of heating elements to be energized and generates control signals that are used by the heating element driver circuit.

A security module 514 restricts operation of the stovetop control system 600 to only those users authorized to use the system. For example, the application 404 may upon initial startup or after a certain period of time in which the stovetop control system 400 has not been used, display a request for user entry of authorization information through the GUI 410. After the user has inputted the authorization information, the security module 514 may then compare the entered authorization information with that stored in the user security files 414. If the entered authorization information has been properly entered, the security module 514 may then allow entry of other user input for operation of the stovetop control system.

It should be appreciated that the modules described herein are provided only as an example of a computing device that may execute the heating structure controller application 404 according to the teachings of the present invention, and that other computing devices may have the same modules, different modules, additional modules, or fewer modules than those described herein. For example, one or more modules as described in FIG. 5 may be combined into a single module. As another example, certain modules described herein may be encoded and executed on other computing devices, such as the remote computing device 420 used by the user.

Figure 6:
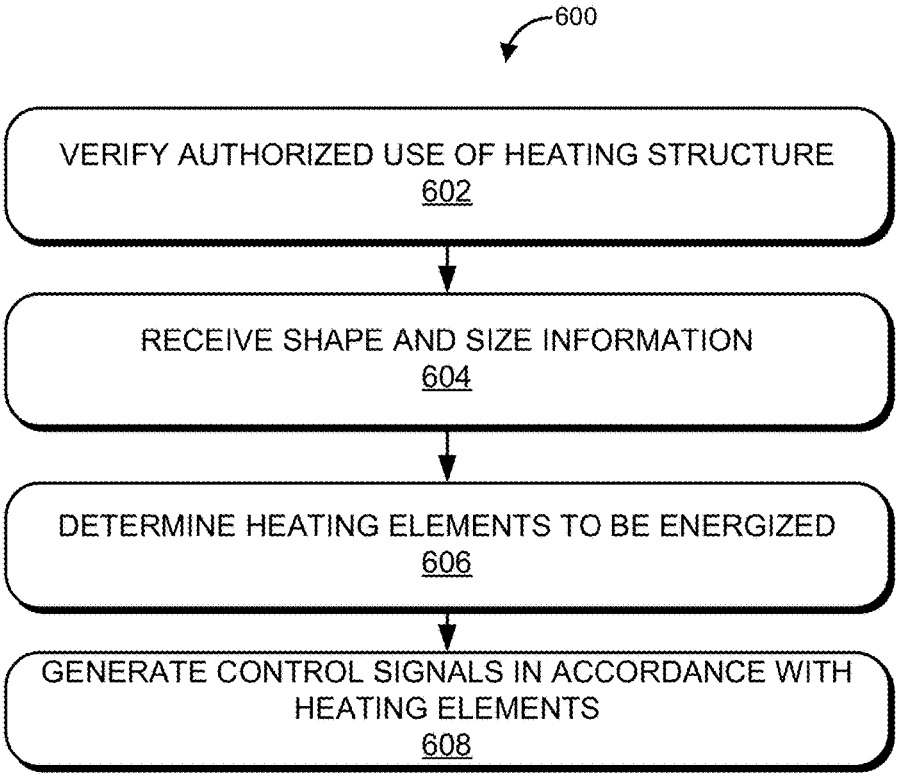
FIG. 6 illustrates an example flowchart depicting an example process for controlling a heating structure according to the teachings of the present disclosure.

FIG. 6 illustrates an example process that may be performed by the heating structure controller application 404 according to the teachings of the present disclosure. Initially in step 602, the application 404 verifies authorized use of the stovetop. To this end, the application 404 generates a GUI or other suitable user interface to the display requesting entry of a password or other form of authorization information. The application 404 compares this information with the security files 414 stored in the data source 406 and allows use of the stovetop control system only upon successful verification of the received information. For example, if an item is sensed on the stovetop, the application 404 may generate a prompt for authorization on the GUI, and energize selective heating elements conforming to the shape, size, and location of the item when proper authorization is received.

Authorization information other than passwords may be used. For example, the application 404 may display a region of the GUI which may be touched by a finger of the user for receiving information associated with a fingerprint. The application 404 may associated the fingerprint with a particular user and offer one or more preset settings assigned to that particular user. Additionally, the system may include a camera that receives information associated with one or more facial features of the user that may be compared with facial information stored in the security files to ensure the user is authorized to use the stovetop control system.

In step 604, the application 404 receives shape, size, location, and heat intensity information associated with a particular portion of the heating structure to be heated. In one embodiment, the shape, size, location, and heat intensity information is manually entered by the user. For example, the application 404 may receive, via the GUI 410, information associated with a certain shape, such as a circle including a diameter representing the portion of the heating structure to be heated. The GUI 410 may be, for example, implemented on a touch screen device that is mounted on a surface of the stovetop such that the user can indicate the desired size and shape while facing the stovetop appliance. In another embodiment, the shape, size, location, and heat intensity information may be automatically determined using sensors configured in the heating structure. For example, the application 404 may receive signals from multiple light sensors configured proximate each heating element that detects the presence of a pot or pan at each heating element for automatically determining the shape, size, location, and heat intensity of the heating structure to be heated.

In step 606, the application 404 determines which heating elements are to be energized according to the received shape, size, location, and heat intensity information. The application 404 maps the received shape, size, location, and heat intensity information to certain heating elements that would generate the desired shape, size, location, and heat intensity of the region of the heating structure. In one embodiment, the application 404 may perform an algorithm that calculates which heating elements may be energized to achieve the desired shape, size, location, and heat intensity. In another embodiment, the application 404 may access a standard shape mapping file from among multiple standard shapes that most closely matches the desired shape, size, location, and heat intensity. For example, the standard shape mapping files may include multiple files for each of several shapes, such as circles, squares, and rectangles, in which each file stores heating element mapping information for a particular shape, size, location, and heat intensity. So when the application 404, for example, receives shape, size, location, and heat intensity information associated with a circle having a diameter of 7.0 inches, the application 404 may access a standard shape mapping file that includes mapping information for energizing those heating elements that would produce a circle at, or close to, 7.0 inches in diameter.

In step 608, the application 404 generates control signals for heating selected heating elements and transmits the control signals to the heating structure. In one embodiment, the application 404 may also generate light indicator signals for energizing light indicators that indicate to the user which heating elements are being energized at any given point in time. The application 404 may generate the light indicator signal independently of the control signals used to control operation of the heating elements. Conversely, the light indicators may be coupled to the control signals used for selectively energizing the heating elements such that each light indicator is energized whenever its respective heating element is energized.

The application 404 may repeatedly perform the above-described steps throughout operation of the stovetop control system. Nevertheless, when use of the stovetop control system is no longer needed or desired, the process ends.

It should be appreciated that the steps described herein are provided only as an example of a process that is performed by the heating structure controller application 404 according to the teachings of the present invention, and that the heating structure controller application 404 may perform fewer, more, or different types of steps than those described herein. For example, the application 404 may perform multiple steps described above as a single step, or perform a single step as multiple, distributed steps. As another example, certain steps described herein are performed by other components of the stovetop control system 400, such as by the remote computing device 420.

Those skilled in the art will appreciate that variations from the specific embodiments disclosed above are contemplated by the invention. The invention should not be restricted to the above embodiments, but should be measured by the following claims.

What is claimed is:

1. A heating appliance for an object, the heating appliance comprising:

a heating structure having a lower surface and a flat upper surface for supporting and imparting heat into the object; and an array of heating elements arranged on the lower surface of the heating structure in an m×n array having m columns and n rows, each element thermally coupled to a region of the structure for heating its respective region of the structure independently of other regions of the structure associated with the other heating elements;

an array of light sensors arranged on the lower surface of the heating structure proximate the array of heating elements to detect a blockage of light at the array of light sensors from a placement of the object on the flat upper surface of the heating structure; and a controller to:

display a plurality of shapes on a graphical user interface (GUI), wherein the GUI is located separate from the controller and configured to communicate with the controller using wireless communications, the plurality of shapes comprising at least one of a circle, a rectangle, and a hexagon;

receive size and location information for the object on the flat upper surface of the heating structure from the array of light sensors;

display a size and location representation for the object on the flat upper surface of the heating structure on the GUI;

receive a user selection of one of the shapes through the GUI;

receive a user selection of a size for the selected one shape through the GUI comprising at least one of an approximate diameter of the circle and an approximate length of a side of the rectangle;

receive a user selection of a location for the selected shape on the flat upper surface of the heating structure through the GUI;

map the selected one shape, the selected size, and the selected location to a heating region representing a portion of the heating elements having the selected one shape at the selected size at the selected location on the flat upper surface; and selectively energize the portion of the heating elements.

2. The heating appliance of claim 1, wherein the heating structure comprises:

an element mounting member on which the heating elements are mounted; and a glass plate thermally coupled to the element mounting member, the glass plate comprising the upper surface.

3. The heating appliance of claim 2, wherein the element mounting member is made of a ceramic material.

4. The heating appliance of claim 1, wherein a portion of the heating elements are selectively energized such that their respective regions form a specified location of the heating structure that is heated.

5. The heating appliance of claim 1, wherein a portion of the heating elements are selectively energized according to a specified heat intensity.

6. The heating appliance of claim 3, wherein the ceramic material comprises an array of depressions into which the heating elements are disposed, each heating element comprising an elongated section of electrically resistive material bent into a semi-circular shape.

7. The heating appliance of claim 1, further comprising a plurality of light indicators each configured proximate one of the heating elements, each light indicator configured to generate light when its respective heating element is energized.

8. The heating appliance of claim 1, wherein the object comprises a pot or pan adapted to cook food.

9. A selective shape and size heating system comprising:

a plurality of heating elements arranged on a heating structure, each element thermally coupled to a region of the structure for heating its respective region of the structure independently of other regions of the structure associated with the other heating elements;

an array of light sensors arranged on the lower surface of the heating structure proximate the array of heating elements to detect a blockage of light at the array of light sensors from a placement of the object on the flat upper surface of the heating structure; and a controller coupled to the heating elements to:

display a plurality of shapes on a graphical user interface (GUI), wherein the GUI is located separate from the controller and configured to communicate with the controller using wireless communications, the plurality of shapes comprising at least one of a circle, a rectangle, and a hexagon;

receive size and location information for the object on the flat upper surface of the heating structure from the array of light sensors;

display a size and location representation for the object on the flat upper surface of the heating structure on the GUI;

receive user selection of one of the shapes through the GUI;

receive user selection of a size for the selected one shape through the GUI comprising at least one of an approximate diameter of the circle and an approximate length of a side of the rectangle;

receive a user selection of a location for the selected shape on the flat upper surface of the heating structure through the GUI;

map the selected one shape, the selected size, and the selected location to a heating region representing a portion of the heating elements having the selected one shape at the selected size at the selected location on the flat upper surface; and selectively energize the portion of the heating elements.

10. The selective shape and size heating system of claim 9, wherein the controller is configured to:

receive temperature information from an array of sensors coupled to corresponding ones of the heating elements; and determine the subset of heating element to be used according to the received sensor information.

11. The selective shape and size heating system of claim 10, wherein the sensors comprise at least one of a plurality of thermal sensors thermally coupled to its respective heating element, or a plurality of light sensors disposed proximate its respective heating element.

12. The selective shape and size heating system of claim 9, further comprising an array of switches electrically coupled to corresponding ones of the heater elements, each switch configured to, under control of the controller, selectively energize its respective heater element.

13. The selective shape and size heating system of claim 12, wherein the array of switches comprise an array of metal oxide semiconductor field effect transistor (MOSFET) devices.

14. The selective shape and size heating system of claim 9, wherein the heating elements are arranged in an m×n array having m columns and n rows, each m'th column of heating elements electrically coupled to one of a plurality of first switches for selectively energizing its respective m'th column of heating elements, and each n'th row of heating elements electrically coupled to one of a plurality of second switches for selectively energizing its respective n'th row of heating elements.

15. A heating method comprising:

displaying, using at least one processor executing instructions stored in at least one memory, a plurality of shapes on a graphical user interface (GUI), wherein the GUI is located separate from the controller and configured to communicate with the controller using wireless communications, the plurality of shapes comprising at least one of a circle, a rectangle, and a hexagon;

displaying a size and location representation on the GUI for an object located on a flat upper surface of a heating structure, the size and location representation based at least on information received from an array of light sensors arranged on a lower surface of the heating structure to detect a blockage of light at the array of light sensors from the placement of the object on the flat upper surface of the heating structure;

receiving user selection of one of the shapes, a size, and a location for the selected shape on the flat upper surface through the GUI of a portion of the heating structure to be heated from a user via the GUI, the size comprising at least one of an approximate diameter of the circle and an approximate length of a side of the rectangle and the heating structure comprising a plurality of heating elements arranged on a heating structure, each element thermally coupled to a region of the structure for heating its respective region of the structure independently of other regions of the structure associated with the other heating elements;

mapping, using the processor, the selected one shape, the selected size, and the selected location to a heating region representing a portion of the heating elements having the selected one shape at the selected size at the selected location on the flat upper surface; and selectively energizing, using the processor, the portion of the heating elements.

16. The heating method of claim 15, further comprising energizing the subset of heating elements using an array of switches electrically coupled to corresponding ones of the heater elements.

17. The heating method of claim 16, wherein the array of switches comprise an array of metal oxide semiconductor field effect transistor (MOSFET) devices.

18. The heating method of claim 15, further comprising:

receiving temperature information from an array of sensors coupled to corresponding ones of the heating elements; and determining the subset of heating element to be used according to the received sensor information.

19. The heating appliance of claim 1, wherein the shapes comprises at least one of a circle, a rectangle, a square, a triangle, and a hexagon.

20. The selective shape and size heating system of claim 9, wherein the shapes comprises at least one of a circle, a rectangle, a square, a triangle, and a hexagon.

* * * * *